US009797110B1

(12) United States Patent
Milani-nia

(10) Patent No.: US 9,797,110 B1
(45) Date of Patent: Oct. 24, 2017

(54) COFFERDAM

(71) Applicant: Milani Construction, LLC, Washington, DC (US)

(72) Inventor: Saeed Milani-nia, Reisterstown, MD (US)

(73) Assignee: MILANI CONSTRUCTION, LLC, Washington, DC (US)

( * ) Notice: Subject to any disclaimer, the term of this patent is extended or adjusted under 35 U.S.C. 154(b) by 0 days.

(21) Appl. No.: 15/182,538

(22) Filed: Jun. 14, 2016

(51) Int. Cl.
*E02D 19/04* (2006.01)

(52) U.S. Cl.
CPC ..... *E02D 19/04* (2013.01)

(58) Field of Classification Search
USPC ..... 405/11–13
See application file for complete search history.

(56) References Cited

U.S. PATENT DOCUMENTS

2002/0110421 A1* 8/2002 Fowler ..... E01F 5/005 405/13
2013/0294835 A1* 11/2013 Schalley ..... E02D 5/60 405/12

FOREIGN PATENT DOCUMENTS

GB 2226843 A * 7/1990 ..... E02D 23/00

* cited by examiner

*Primary Examiner* — Kyle Armstrong
(74) *Attorney, Agent, or Firm* — Loza & Loza, LLP; Michael I. Angert

(57) ABSTRACT

An enclosure having a bottom plate, a wall, and an opening to pass a portion of a pier into the enclosure. A first sealing member coupled to the bottom plate. Watertight tanks coupled to the enclosure float the enclosure in a body of water, at a position above a footing of the pier with the portion of the pier in the enclosure, sink the enclosure to compress the first sealing member between the bottom plate and a ledge of the footing, and re-float the enclosure. A method includes floating and navigating the enclosure to the position and adding weight to sink the enclosure. A plurality of adjustable length structures may be lengthened to exert a downward force on the bottom plate to secure it to the ledge. A second sealing member may be forced into the opening between the pier and wall of the enclosure to facilitate dewatering the enclosure.

9 Claims, 9 Drawing Sheets

COFFERDAM

FIELD OF THE DISCLOSURE

This application is related to cofferdams, and more particularly to floatable and sinkable portable cofferdams.

BACKGROUND

A cofferdam is a watertight enclosure that is dewatered (e.g., pumped dry) to facilitate work below a surface of a body of water. Cofferdams may be used, for example, in connection with inspection, maintenance, demolition, and/or construction of civil engineering projects such as bridges, walkways, or dams that includes a component that extends from on or below the floor of a body of water. Cofferdams may also be used in the repair of ships.

Construction of cofferdams for civil engineering projects may begin with the dredging of soil and/or soft sediment from an area on which the cofferdam is to be constructed. Some cofferdams may then be constructed by driving sheet piles into the floor of the body of water around a worksite. The tops of the sheet piles extend above the surface of the body of water after the bottoms of the sheet piles have been driven into the floor of the body of water. The sheet piles are connected together, for example by interconnecting, to form a wall enclosing the sides of the worksite. Internal bracing and tying are applied as needed. An underwater concrete soil course can be poured into the cofferdam to seal the bottom from water entry. The watertight enclosure is then dewatered to provide a dry environment in which work can be performed. Other cofferdams may be constructed by filling vinyl tubes with water. The vinyl tubes may rest on the floor of the body of water and have a height that is greater than the surface of the body of water, thus giving an overall negative buoyancy to the filled vinyl tubes. The worksite may be surrounded by such water-filled vinyl tubes to form a watertight enclosure. The weight of each filled vinyl tube holds the tube in place on the floor of the body of water. Again, watertight enclosure is then dewatered to provide a dry environment in which work can be performed.

Cofferdams, such as those used to surround or partially surround a worksite have a drawback in that they contact, disturb, and/or penetrate the floor of the body of water by being driven into and/or resting on the floor of the body of water. A type of cofferdam that can be used to surround or partially surround a worksite without contacting, disturbing, and/or penetrating the floor of the body of water surrounding the worksite is desirable.

SUMMARY

The following presents a simplified summary of some aspects to provide a basic understanding of such aspects. This summary is not an extensive overview of all contemplated features of the disclosure, and is intended neither to identify key or critical elements of all aspects nor to delineate the scope of any or all aspects. Its sole purpose is to present various concepts of some aspects in a simplified form as a prelude to the more detailed description that is presented later.

According to one aspect, a cofferdam for use with a pier extending above a surface of a body of water, from a footing below the surface of the body of water, may include an enclosure, a first sealing member, and a plurality of watertight tanks. The enclosure may include a bottom plate having a perimeter, a first side bounded by the perimeter, and an opposing second side bounded by the perimeter. The enclosure may also include a wall having a base and an opposing top, the base coupled to the first side of the bottom plate at and/or adjacent to the perimeter and, with the bottom plate, may define an interior of the enclosure therein. The enclosure may also include an opening configured to pass a portion of the pier into the enclosure the opening. The opening may include a first portion in the wall that is aligned with a second portion in the bottom plate. The first sealing member may be coupled to the second side of the bottom plate, adjacent to the second portion of the opening. The plurality of watertight tanks may be coupled to the enclosure and may be configured to float the enclosure in the body of water, at a position above the footing with the portion of the pier in the enclosure, when the plurality of watertight tanks is in an empty state. The plurality of watertight tanks may further be configured to sink the enclosure in the body of water from the position, bring the first sealing member into contact with a ledge on the footing, and compress the first sealing member between the bottom plate and the ledge, when the plurality of watertight tanks is in a filled state. The plurality of watertight tanks may be heavier in the filled state than in the empty state. The ledge may be adjacent to the pier and spaced apart from a floor of the body of water. The top of the wall may extend above a surface of the body of water. The plurality of watertight tanks may further be configured to re-float the enclosure in the body of water when the plurality of watertight tanks is returned to the empty state.

According to another aspect, a method of using a cofferdam with a pier extending above a surface of a body of water, from a footing below the surface of the body of water, may include floating the cofferdam in the body of water and navigating the cofferdam to the pier while the cofferdam is floating. According to one feature, the method may also include navigating the cofferdam to a position above the footing with a portion of the pier in an enclosure of the cofferdam, while the cofferdam is floating. According to one aspect, the enclosure may include a bottom plate having a perimeter, a first side bounded by the perimeter, and an opposing second side bounded by the perimeter. The enclosure may also include a wall having a base and an opposing top. In one aspect, the base may be coupled to the first side of the bottom plate at and/or adjacent to the perimeter. According to one implementation, the wall, with the bottom plate, may define an interior of the enclosure therein. According to one aspect, the enclosure may also include an opening configured to pass the portion of the pier into the enclosure. In one implementation, the opening may include a first portion in the wall that is aligned with a second portion in the bottom plate. In one aspect, a first sealing member may be coupled to the second side of the bottom plate, adjacent to the second portion of the opening.

In an implementation, the method may further include adding weight to the cofferdam to sink the cofferdam from the position above the footing with the portion of the pier in the enclosure. According to one aspect, the weight may be added to bring the first sealing member into contact with a ledge on the footing, and may be added to compress the first sealing member between the bottom plate and the ledge. According to one implementation, the ledge may be adjacent to the pier and spaced apart from the floor of the body of water. According to one aspect, the top of the wall may extend above a surface of the body of water.

In an implementation, the method may further include lengthening a plurality of adjustable length structures coupled between the bottom plate and a structure supported by the pier, such as a bridge or one or more beams of the bridge, to exert a downward force on the bottom plate to secure the cofferdam to the ledge and oppose vertical and lateral forces imposed on the cofferdam.

According to the implementation, the method may further include forcing a second sealing member into a first gap in the first portion of the opening between the pier and wall of the enclosure. According to an aspect, the first sealing member and the second sealing member may prevent the body of water from entering the interior of the enclosure at edges of the opening. In an implementation, the method may further include dewatering the interior of the enclosure.

These and other aspects will become more fully understood upon a review of the detailed description, which follows. Other aspects, features, and implementations will become apparent to those of ordinary skill in the art, upon reviewing the following description of specific implementations in conjunction with the accompanying figures. While features may be discussed relative to certain implementations and figures below, all implementations can include one or more of the advantageous features discussed herein. In other words, while one or more implementations may be discussed as having certain advantageous features, one or more of such features may also be used in accordance with the various implementations discussed herein.

DRAWINGS

The drawings provided herewith are not drawn to scale. Various features, nature, and advantages may become apparent from the detailed description set forth below when taken in conjunction with the drawings in which like reference characters identify correspondingly throughout.

DETAILED DESCRIPTION

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details. In some instances, well known structures and components are shown in block diagram form in order to avoid obscuring such concepts.

As used herein the term "body of water" may mean an ocean, a lake, a reservoir, a stream, a river, a canal, or any part thereof. The body of water may be fresh water, transitional water (i.e., partly saline), or coastal water. The body of water may be natural, human-made, or a natural body of water that is changed in character as a result of physical alterations by human activity. The disclosure is exemplary and a body of water may be described in alternate ways that are not listed but that can be appreciated by persons of skill in the art.

As used herein, the term "surface of the body of water" may mean a point or plane where the atmosphere and body of water meet.

As used herein the term "watertight" may mean closely sealed, fastened, or fitted so that no water enters or passes through.

As used herein the phrase "prevent water from flowing into an enclosure" may mean to stop, inhibit, block, or check a leakage or water into the enclosure between a degree to which the enclosure is watertight and a degree to which water seeping into the enclosure may be disposed of with a sump pump device or equivalent.

Operational Environment

Figure 1:
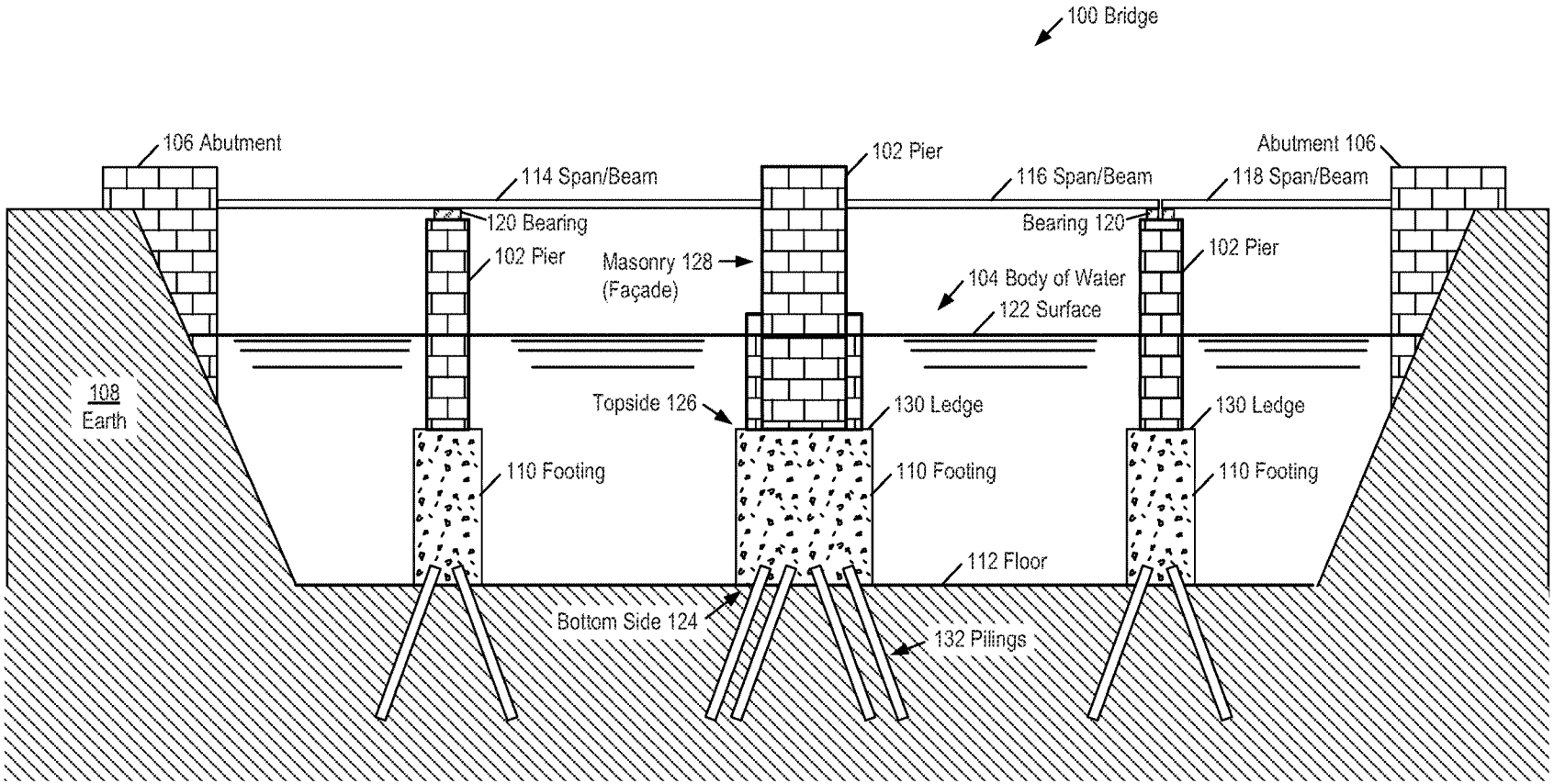
FIG. 1 is an illustration of a bridge with multiple piers.

FIG. 1 is an illustration of a bridge 100 with multiple piers 102. A bridge 100 is a structure that may carry a road, path, railroad, pipeline, or canal (not shown) across a body of water 104 or some other obstacle. The bridge 100 extends on either side from abutments 106 (e.g., end-bents) that may be constructed to support the lateral pressure of the bridge 100. The abutments 106 may extend from the shore or earth 108 on both sides of the bridge 100.

A pier 102, such as a column pier, may be an upright support for a superstructure of the bridge 100. A pier 102 may extend above a surface 122 of the body of water 104 from a footing 110 below the surface 122 of the body of water 104. The footing 110 may have a bottom on or below a floor 112 of the body of water 104. As used herein, the floor 112 of the body of water 104 may be used to refer to a top layer of earth 108 at a lowermost depth of the body of water 104 in the area surrounding the footing 110. By way of example, the floor 112 of the body of water 104 may be ocean bed, a riverbed, a streambed, or a bed of a human made body of water 104. The floor 112 of the body of water 104 is below (e.g., under, underneath, lower than) the surface 122 of the body of water 104. The footing 110 may be built on (and may be integral to) a plurality of pilings 132 (e.g., friction pilings, H-pilings) that may have been driven into the earth 108 below the floor 112 of the body of water 104.

In some aspects, a substructure of a bridge 100 may include the abutments 106, piers 102, footings 110, and pilings 132. In some aspects a superstructure of the bridge 100 may include components that span an obstacle the bridge 100 is intended to cross. The superstructure may include the spans/beams 114, 116, 118 (e.g., structural members, girders) and a bridge deck, handrails, sidewalk, lighting, and drainage features (not shown). Thus, the substructure may support the superstructure.

The bridge 100 may include multiple spans 114, 116, 118, which may be of different lengths. Multiple span 114 bridges may implement one or more piers 102 (individually and collectively referred to herein as a pier 102) to support the multiple spans 114, 116, 118 between the abutments 106. The spans 114, 116, 118 may each be comprised of multiple beams (e.g., girders) (not shown). As used herein, the terms "span" and "beam" may be used interchangeably. Accordingly, as described above, a span/beam 114, 116, 118 (e.g., girder) of a bridge 100 may be supported by the pier 102.

A pier 102, for example, may support a middle of a span/beam 114 or a support adjacent edges of two spans/beams 116, 118. In some aspects, the ends or middle of a span/beam 114, 116, 118 may be supported by a bearing 120 on top of a pier 102. The ends of the beam 116 may rest on the bearing 120. There are many types of bearings 120 and their descriptions and uses are known to those of skill in the art and will not be described herein.

A pier 102 may also be any vertical structural support such as a vertical member that supports an end of an arch (not shown).

The disclosure that follows provides examples using a bridge 100 over a body of water 104 and a pier 102 (that may be one of a plurality of piers) that supports the beams 116 of the bridge 100; however, the disclosure is not limited to these examples.

Although illustrated as a girder bridge, the disclosure is also applicable to piers 102 and/or abutments 106 of other types of structures that extend from a body of water, including, for example, arch bridges, suspension bridges, cantilevered bridges, girder bridges, as well as any structure that is in the water to which a cofferdam may find utility.

The geology of the soil at the floor 112 of the body of water 104, or at shallow or moderate depths below the floor 112 of the body of water 104 is often not suitable for construction of a pier 102. In many civil engineering projects, pilings 132 may be driven below the floor 112 of the body of water 104 into the earth 108 to form a suitable sub-foundation. The pilings 132 may then be coupled to a footing 110 (e.g., foundation pad) upon which the pier 102 may be erected.

The footing 110 may be, for example, a concrete structure or block into which the heads of one or more pilings 132 are embedded. A bottom side 124 (e.g., a bottom portion of an outer surface) of the footing 110 may be located at and/or below the floor 112 of the body of water 104, while a topside 126 (e.g., a top portion of the outer surface) of the footing 110 may be vertically spaced apart (e.g., separated in vertical distance, height) from the floor 112 of the body of water 104. A ledge 130 formed on a topside 126 of the footing my extend outwardly from the pier 102 may surround some or all of the topside 126 of the footing 110. The height of the topside 126 of the footing 110, and thus the ledge 130, is greater than the height of the floor 112 of the body of water 104.

The footing 110 may be any shape and/or combination of shapes, for example, round, oblong, square, rectangular, or any combination thereof. All or some of the topside 126 the footing 110 may be flat (e.g., planar). All or some of the topside 126 of the footing 110 may lie in a horizontal plane (e.g., a level plane, a plane parallel to a horizon). In some aspects, the center of the topside 126 of the footing 110 may be higher than the edges of the topside 126 of the footing 110 to establish a slope extending outward and downward from the center. In some aspects, the edges of the topside 126 of the footing 110 may be square or non-square (e.g., chamfered, beveled, rounded).

The pier 102 may be erected on the topside 126 of the footing 110. The pier 102 may support one or more beams 114, 116, 118 of one or more bridge 100 spans. The pier 102 may include a central structural component (not shown) such as a reinforced concrete column. The central structural component may be covered by a masonry façade (e.g., a frontage, a fascia) (hereinafter masonry 128).

The masonry 128 may include individual masonry units laid in and bound together by mortar (not shown). The masonry 128 may include, for example, stonework (stone blocks that can be dressed or rough), brickwork, or other suitable types. The common materials of masonry 128 include building stone such as marble, granite, sandstone, travertine, and limestone, cast stone, concrete block, and/or brick.

Figure 2A:
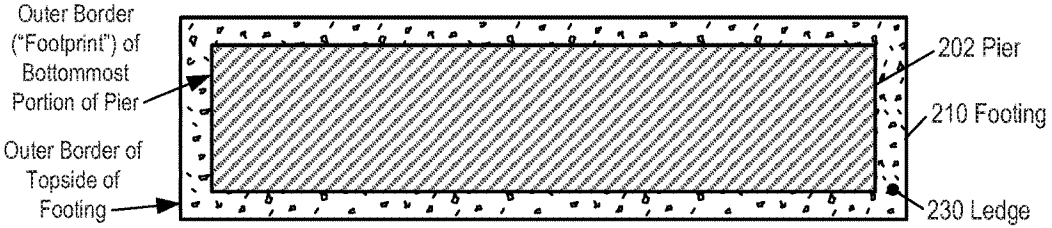
FIG. 2A is a plan view of a first example of a footing and pier according to the disclosure.
Figure 2B:
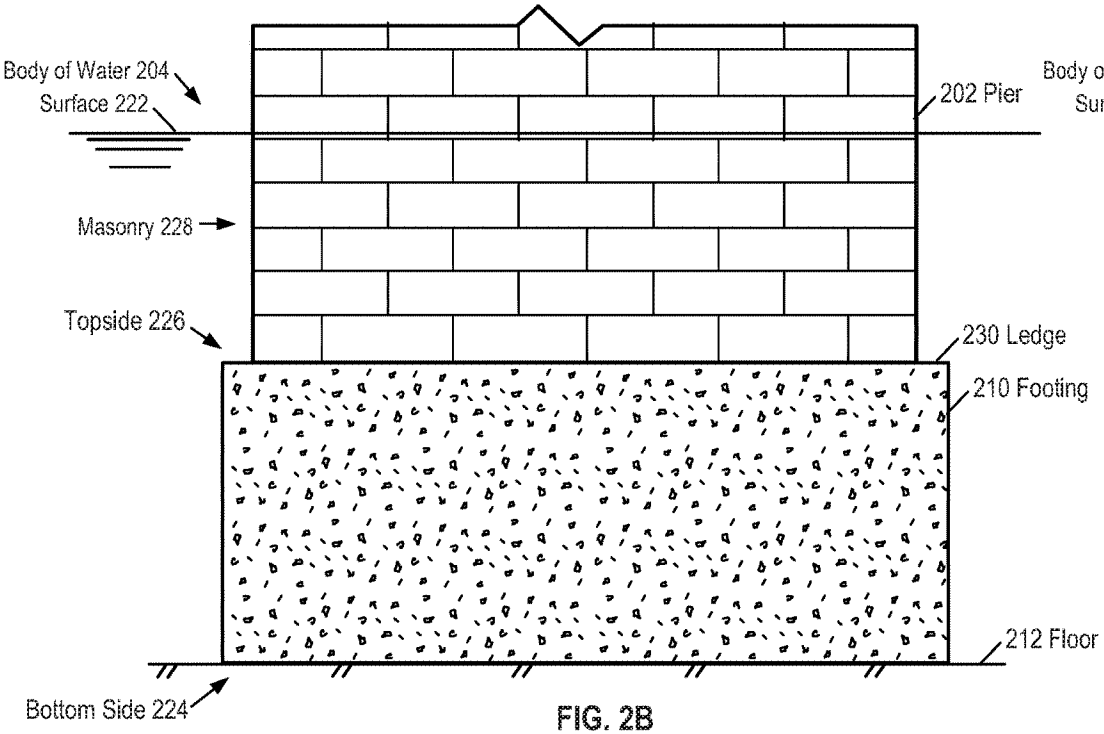
FIG. 2B is a side elevation view of the first example of the footing and pier of FIG. 2A.
Figure 2C:
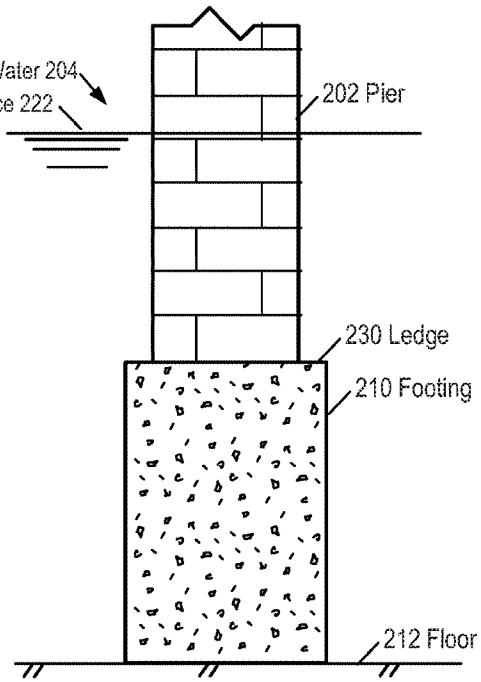
FIG. 2C is a front elevation view of the first example of the footing and pier of FIG. 2A.

FIG. 2A is a plan view of a first example of a footing 210 and pier 202 in accordance with the disclosure. FIG. 2B is a side elevation view of the first example of the footing 210 and pier 202 of FIG. 2A. FIG. 2C is a front elevation view of the first example of the footing 210 and pier 202 of FIG. 2A. In the illustrations of FIG. 2A, FIG. 2B, and FIG. 2C, a profile (e.g., an outline represented in sharp relief) of the pier 202 in side and front elevation views remains constant (e.g., does not change) with height.

As illustrated in the drawings, a ledge 230 may be formed on a topside 226 of a footing 210, where the ledge 330 is adjacent to the pier 202, the ledge 230 extends outwardly from the pier 202, the pier 202 is erected on the footing 210, and the ledge 230 is spaced apart from the floor 212 of the body of water 204 surrounding the footing 210. As exemplified in FIG. 2C, an outer border of the bottommost portion of the pier 202, including the masonry façade, projected onto the topside of the footing 310 (e.g., the "footprint" of the pier 202 on the footing 210) may be smaller than the outer border of the topside 226 of the footing 210. In this case, the ledge 230 may be formed by a surface of the footing 210 that is adjacent to the pier 202 and extending outward from the pier 202. The ledge 230 is spaced apart from a floor 212 of the body of water 204 because the ledge 230 is formed on the topside 226 of the footing 210.

Figure 3A:
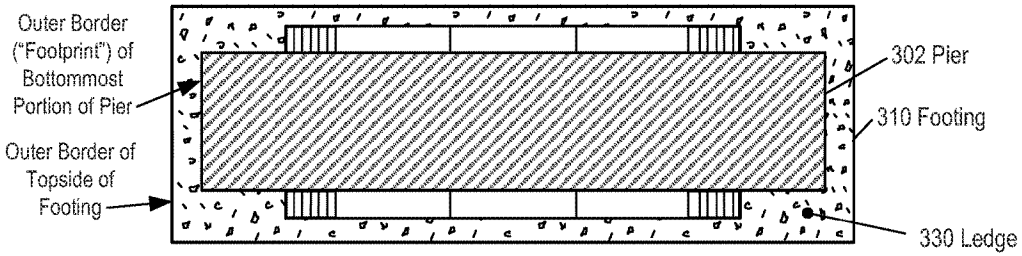
FIG. 3A is a plan view of a second example of a footing and pier in accordance with the disclosure.
Figure 3B:
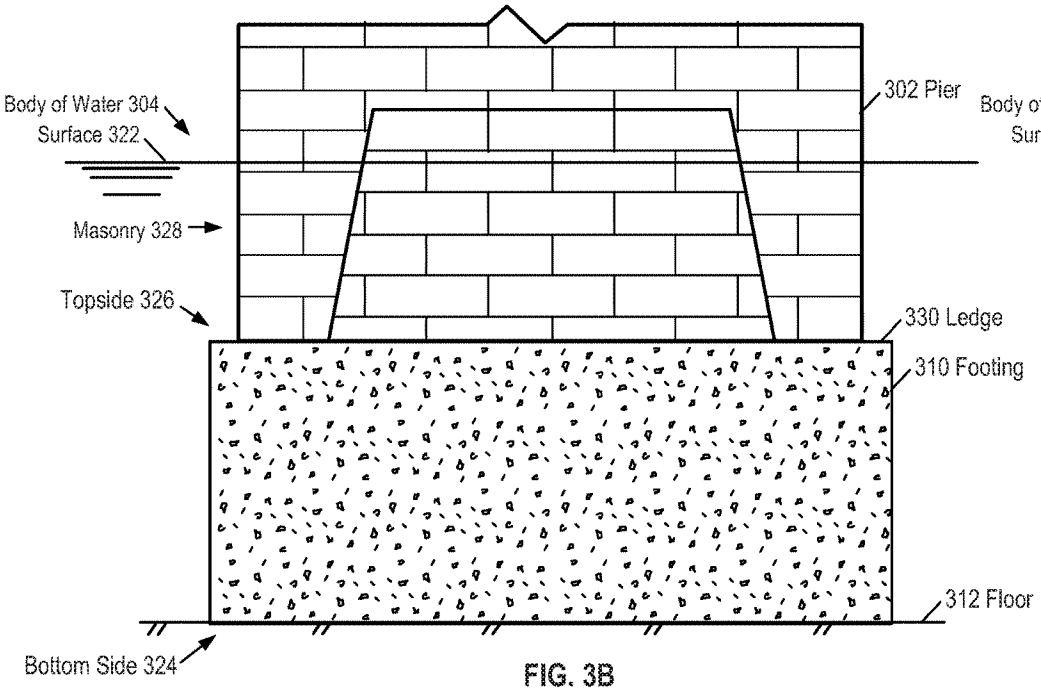
FIG. 3B is a side elevation view of the second example of the footing and pier of FIG. 3A.
Figure 3C:
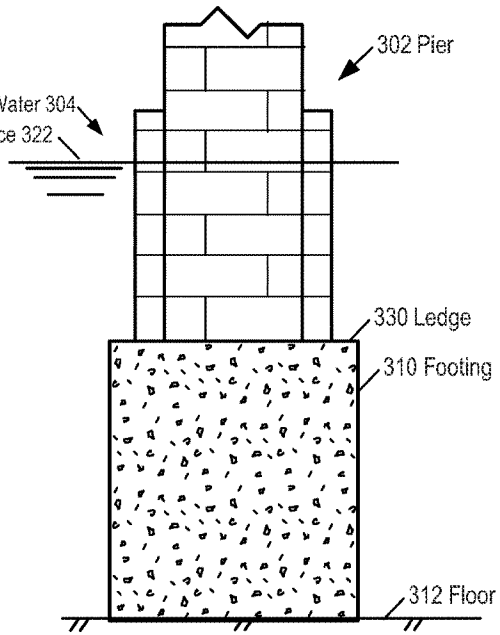
FIG. 3C is a front elevation view of the second example of the footing and pier of FIG. 3A.

FIG. 3A is a plan view of a second example of a footing 310 and pier 302 in accordance with the disclosure. FIG. 3B is a side elevation view of the second example of the footing 310 and pier 302 of FIG. 3A. FIG. 3C is a front elevation view of the second example of the footing 310 and pier 302 of FIG. 3A. In the illustrations of FIG. 3A, FIG. 3B, and FIG. 3C, a profile (e.g., an outline represented in sharp relief) of the pier 302 in side and front elevation views changes with height (e.g., width and thickness changes with height).

As illustrated in the drawings, a ledge 330 may be formed on a topside 326 of a footing 310, where the ledge 330 is adjacent to the pier 302, the ledge 330 extends outwardly from the pier 302, the pier 302 is erected on the footing 310, and the ledge 330 is spaced apart from the floor 312 of the body of water 304 surrounding the footing 310. As exemplified in FIG. 3C, an outer border of the bottommost portion of the pier 302, including the masonry façade, projected onto the topside of the footing 310 (e.g., the "footprint" of the pier 302 on the footing 310) may be smaller than the outer border of the topside 326 of the footing 310. In this case, the ledge 330 may be formed by a surface of the footing 310 that is adjacent to the pier 302 and extending outward from the pier 302. The ledge 330 is spaced apart from a floor 312 of the body of water 304 because the ledge 330 is formed on the topside 326 of the footing 310.

A cofferdam in accordance with the disclosure presented herein may be used on various piers including piers 202, 302 that have constant profiles or changing profiles with respect to height of the pier 202, 302 above a ledge 230, 330 of a footing 210, 310.

From time-to-time it may be necessary to remove and replace some or all of the masonry 228, 328 of a pier 102, 202, 302 or perform an inspection, maintenance, repair, waterproofing, or other task on the pier 102, 202, 302 without regard to whether the pier has a masonry 228, 328 surface or layer. However, as described, the pier 102, 202, 302 may extend above a surface 122, 222, 322 of a body of water 104, 204, 304 from a footing 110, 210, 310 resting on a floor 112, 212, 312 of a body of water 104, 204, 304. Furthermore, the footing 110, 210, 310 and a portion of the pier 102, 202, 302 may be submerged below the surface 122, 222, 322 of a body of water 104, 204, 304. It may therefore be desirable to use a cofferdam to provide a dewatered space (e.g., a dry space) around a portion of the pier 102, 202, 302. Work on that portion of the pier 102, 202, 302 may then be performed in a dry environment in the interior of an enclosure of the cofferdam within the dewatered space.

However, as described, it may be desirable to provide a cofferdam that does not contact, disturb, and/or penetrate (e.g., does not interfere with, alter, upset the natural and/or ecological balance or relations of) a floor 112, 212, 312 of the body of water 104, 204, 304 surrounding the footing 110, 210, 310 (e.g., surrounding the worksite). Cofferdams made of sheet piles or water filled vinyl tubes therefore may not be suitable. Accordingly, there may be provided a cofferdam for use with a pier 102, 202, 302 extending above the surface 122, 222, 322 of the body of water 104, 204, 304 from a footing 110, 210, 310 below the surface of the body of water 104 that does not contact, disturb, and/or penetrate the floor 112, 212, 312 of the body of water 104, 204, 304 surrounding the footing 110, 210, 310.

Exemplary Cofferdam Apparatus

Figure 4A:
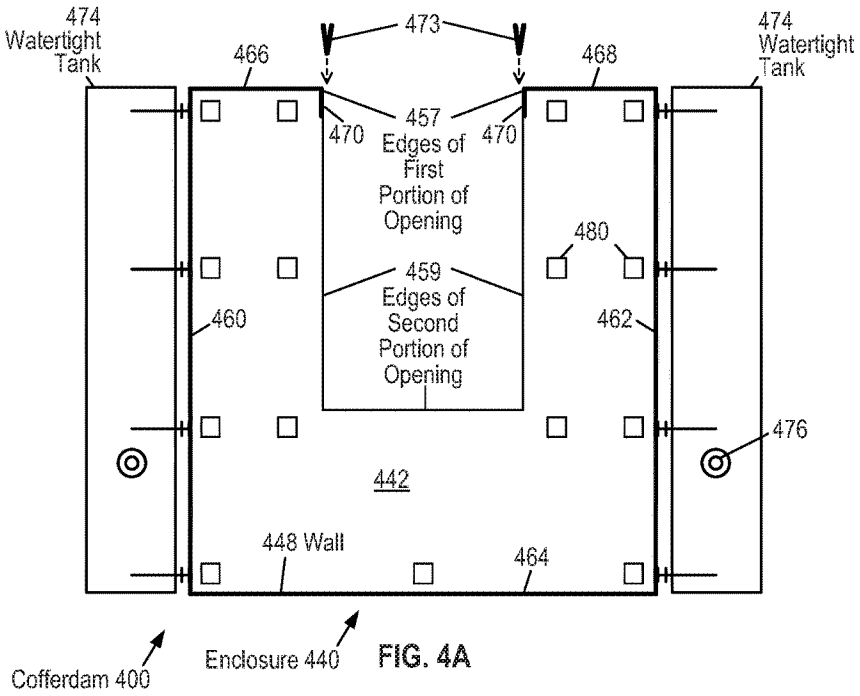
FIG. 4A is a plan view of a cofferdam for use with a pier extending above a surface of a body of water, from a footing below the surface of the body of water in accordance with the disclosure.
Figure 4B:
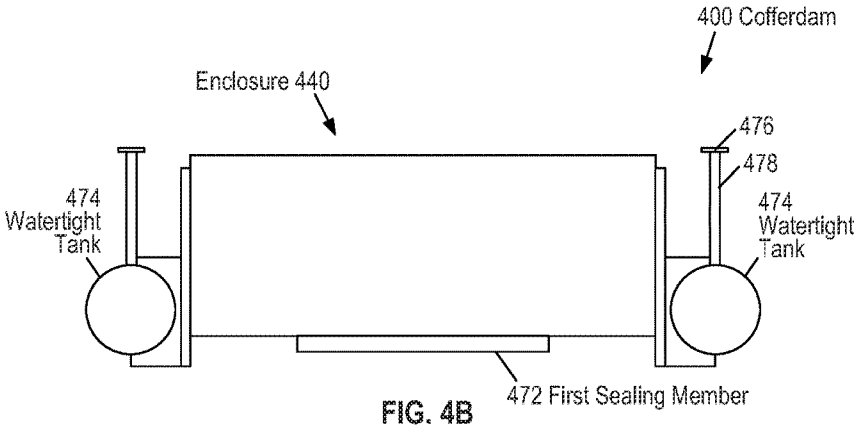
FIG. 4B is a rear elevation view of the cofferdam of FIG. 4A.
Figure 4C:
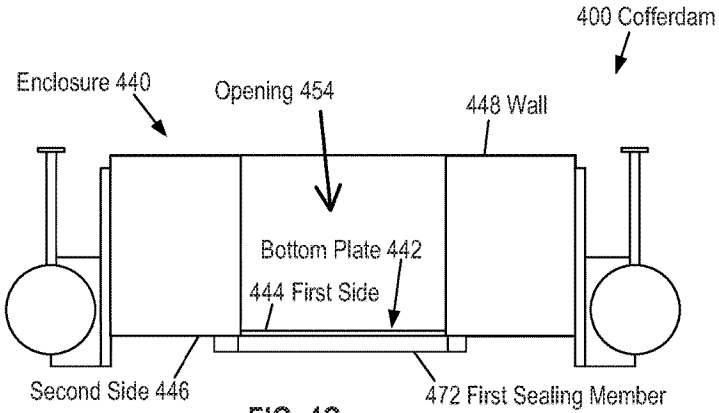
FIG. 4C is a front elevation view of the cofferdam of FIG. 4A.
Figure 4D:
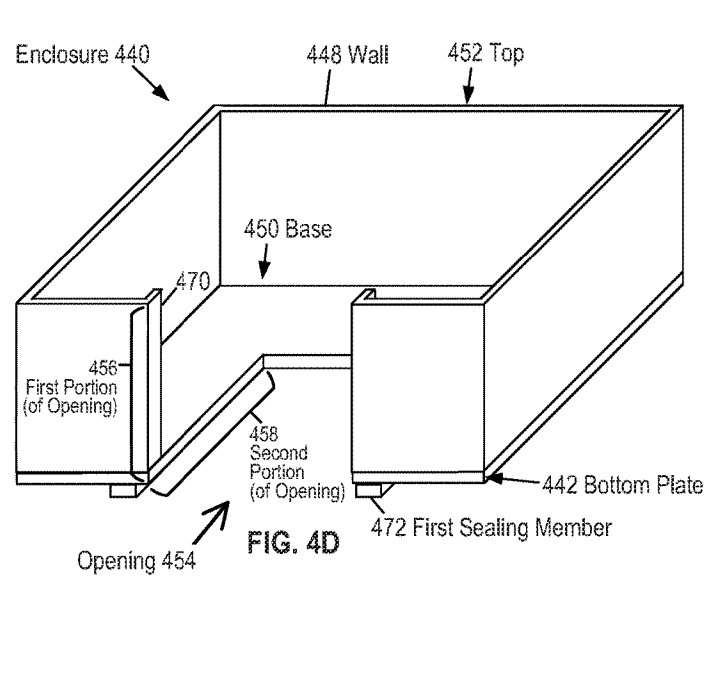
FIG. 4D is a perspective view of an enclosure of the cofferdam of FIG. 4A, separated from the remaining portions of the cofferdam of FIG. 4A.

FIG. 4A is a plan view of a cofferdam 400 for use with a pier extending above a surface of a body of water, from a footing below the surface of the body of water in accordance with the disclosure. According to one aspect, no portion of the cofferdam 400 contacts, disturbs, and/or penetrates the floor of the body of water surrounding the footing upon which the cofferdam 400 may be seated. FIG. 4B is a rear elevation view of the cofferdam 400 of FIG. 4A. FIG. 4C is a front elevation view of the cofferdam 400 of FIG. 4A. FIG. 4D is a perspective view of an enclosure 440 of the cofferdam 400 of FIG. 4A, separated from the remaining portions of the cofferdam 400 of FIG. 4A.

As illustrated in FIGS. 4A-4D, the cofferdam 400 may include an enclosure 440. According to one aspect, the enclosure 440 includes a bottom plate 442 having a perimeter (e.g., an outer boundary of a closed plane figure, a border, an external edge), a first side 444 bounded by the perimeter, and an opposing second side 446 bounded by the perimeter. The enclosure 440 also includes a wall 448 having a base 450 and an opposing top 452, the base 450 coupled to the first side 444 of the bottom plate 442 at and/or adjacent to the perimeter and, with the bottom plate 442, defining an interior of the enclosure 440 therein. The enclosure 440 further includes an opening 454 configured to pass a portion of the pier into the enclosure 440, the opening 454 includes a first portion 456 in the wall 448 that is aligned with a second portion 458 in the bottom plate 442. The edges 457 of the first portion 456 of the opening 454 in the wall 448 may include edges of the wall 448 itself and/or any face of a contact member 470 (if present). The edges 457 of the first portion 456 of the opening 454 in the wall 448 may corresponding to a profile of a pier in the plane of the wall 448 (e.g., coincident with the first portion 456 of the opening 454) that will be located in the opening 454 when the pier is within the enclosure 440 (e.g., an interior of the enclosure 440). The edges 459 of the second portion 458 of the opening 454 in the bottom plate 442 may include internal edges in the bottom plate 442 (e.g., edges spaced apart from the perimeter of the bottom plate 442 and within an interior of the perimeter of the bottom plate 442). The edges 459 in the bottom plate 442 may correspond to a profile of a pier in the plane of the bottom plate 442 that will be located in the opening 454 when the pier is within the enclosure.

The exemplary plan view of FIG. 4A depicts a plurality of adjustable length structures 480. Only two of the exemplary fifteen of plurality of adjustable length structures 480 are associated with a reference number to avoid cluttering the drawing. Additionally, elevation and perspective views of the adjustable length structures 480 are omitted from the illustrations of FIGS. 4B-4D to avoid cluttering the drawings.

The portion of the pier passes into the enclosure 440 through the opening 454 in the wall 448 and the bottom plate 442. In one aspect, the opening 454 in the wall 448 (e.g., the first portion 456) penetrates through the wall 448 and spans the entire height of the wall 448, from the base 450 to the top 452 of the wall 448. In one aspect, the opening 454 in the bottom plate 442 (e.g., the second portion 458) penetrates through the bottom plate 442 and spans less than the entire length of the bottom plate 442 (e.g., it does not bisect the bottom plate 442). The enclosure 440 may be open to the atmosphere at its top.

As used herein, the term "wall" 448 is used to describe a material object that serves to hold back pressure, such as pressure of water, hydrostatic pressure. The wall 448 exemplified in the disclosure serves to hold back such pressure at least when the cofferdam 400 is seated on the footing, the enclosure 440 is sealed from the body of water, and the interior of the enclosure 440 is dewatered all as described later herein.

As shown in the examples of the disclosure, a wall 448 may include a series of plates coupled together in watertight engagement (e.g., the plates may be welded together or otherwise sealed together). The plates may be coupled together at various angles to form various shapes. Although depicted as a rectangular box that is open to the atmosphere at its top, the wall 448 may form any shape suitable to the worksite formed by the enclosure 440. In an alternative example, the wall 448 may be formed in a cylindrical or oblong shape from one or more plates.

The base 450 of the wall 448 may be coupled to the first side 444 of the bottom plate 442 in watertight engagement with the bottom plate 442 (e.g., the base 450 of the wall 448 may be welded to the first side 444 of the bottom plate 442 or otherwise sealed to the first side 444 of the bottom plate 442). The wall 448 may partially surround the perimeter of the bottom plate 442 to leave room for the opening 454 (e.g., the first portion 456 of the opening) in the wall 448. In the exemplary aspects of the disclosure, the opening 454 may permit entry of a portion of the pier into an interior space defined by the wall 448 and the bottom plate 442 of the enclosure 440 (e.g., into the interior of the enclosure 440). Thus, the wall 448 may define the vertical (or substantially vertical) outer boundaries of the interior of the enclosure 440 while the bottom plate 442 may define the horizontal (or substantially horizontal) lower boundaries of interior of the enclosure 440.

According to one aspect, the wall 448 may include a first side plate 460 coupled to the bottom plate 442 and a second side plate 462 coupled to the bottom plate 442 and opposite to and spaced apart from the first side plate 460. The wall 448 may further include a rear plate 464 coupled to a rear edge of the bottom plate 442, the first side plate 460, and the second side plate 462. The wall 448 may further include a first front plate 466 coupled to a front of the first side plate 460 and the front of the bottom plate 442. The wall 448 may further include a second front plate 468 coupled to the front of the second side plate 462 and the front of the bottom plate 442 and spaced apart from the first front plate 466 to leave room for the opening 454.

According to one aspect, the wall 448 may further include a contact member 470 coupled (e.g., in watertight engagement) to the wall 448 at the opening 454. The contact member 470 may have a face parallel to the pier, wherein a surface area of the face is greater than a cross-sectional surface area of the wall 448 in a plane that bisects the wall 448 and is parallel to the contact member 470.

According to one example, the wall 448 may be formed using ⅜ inch steel plate and the bottom plate 442 may be formed from ¼ inch steel plate. The selection of the thickness and material of the wall 448 and bottom plate 442 are dependent on the circumstances of use and are within the skills of the person skilled in the art; they will not be described herein.

Although not shown, those skilled in the art will appreciate that the enclosure 440 may be strengthened using, for example, structural steel beams welded to the outside and/or inside of the wall 448 and/or bottom plate 442 of the enclosure 440, as well as cross members, blocking, ties and other structural support features as known to those skilled in the art.

As stated, the enclosure 440 may include an opening 454 configured to pass a portion of the pier into the enclosure 440, through the wall 448 and bottom plate 442. Thus, a profile (e.g., an outline represented in sharp relief) of the opening 454 may correspond to the profile of the portion of the pier in such a way to conform the shape of the profile of the opening 454 to the shape of the outermost surface of the portion of the pier within the enclosure 440, while also being wider than the outermost surface to provide clearance for the portion of the pier to pass through the opening 454 and into the interior of the enclosure 440. Thus, the profile of the opening may provide for a first gap (e.g., a space, a separation between objects) between an inner edge of the opening 454 in the wall 448 and a surface of the portion of the pier parallel to the an inner edge of the opening 454 in the wall 448, and may provide for a second gap between an inner edge of the opening 454 in the bottom plate 442 and a surface of the portion of the pier parallel to the inner edge of the opening 454 in the bottom plate 442.

In some aspects, the opening 454 may be defined by an edge 459 of a first void in the bottom plate 442 and an edge 457 of a second void in the wall 448. The opening 454 may have a fixed profile (e.g., an outline represented in sharp relief) corresponding to a profile of the portion of the pier to be received in the opening 454. In other words, the shape of the opening 454 in the plane of the bottom plate 442 may correspond to the shape of the footprint of the pier on the topside of the footing after the portion of the pier has passed into the interior of the enclosure 440 of the cofferdam 400 and the cofferdam 400 is resting on the footing. The shape of the opening 454 in the plane of the wall 448 may correspond to the shape of the front elevation view of the pier (or a cross-section of the pier) after the portion of the pier has passed into the interior of the enclosure 440 of the cofferdam 400 and the cofferdam 400 is resting on the footing.

According to one aspect, when the cofferdam 400 is floated in the body of water, at least a portion of the enclosure 440, and therefore at least a portion of the opening 454, may lie below a surface of the body of water. Accordingly, the opening 454 admits water into the enclosure 440 when the cofferdam 400 is floating in the body of water (e.g., before being sunk and sealed to the footing and pier). Accordingly, the enclosure 440 is not watertight when the cofferdam 400 is floating in the body of water. Therefore, the enclosure 440 does not add to the buoyancy of the cofferdam 400 when the cofferdam 400 is floating in the body of water 104.

The cofferdam 400 may further include a first sealing member 472 coupled to the second side 446 of the bottom plate 442. The first sealing member 472 may be coupled to the second side 446 of the bottom plate 442 at a position adjacent to the second portion 458 of the opening 454. The first sealing member 472 may be a resilient compressible product such as rubber, neoprene. According to one example, the first sealing member 472 may be formed from a 1 inch thick sheet of neoprene rubber. The selection of the thickness and composition of the first sealing member 472 are dependent on the circumstances of use and are within the skills of the person skilled in the art; they will not be described herein.

According to one example, the first sealing member 472 may be coupled to the second side 446 of the bottom plate 442 using an adhesive (not shown) such as a waterproof adhesive. Adhesives and ways to couple the first sealing member 472 to the second side 446 of the bottom plate 442 may be dependent on the circumstances of use and are within the skills of the person skilled in the art; they will not be described herein.

Coupling the first sealing member 472 to the second side 446 of the bottom plate 442 prior to introducing the cofferdam 400 into the body of water may provide a benefit of not having to be concerned with the coupling of the first sealing member 472 to the second side 446 of the bottom plate 442 while the second side 446 of the bottom plate 442 is underwater. Coupling the first sealing member 472 to the second side 446 of the bottom plate 442 prior to introducing the cofferdam 400 into the body of water may provide a benefit of not having to be concerned with placement and alignment of the first sealing member 472 relative to the ledge of the footing during seating of the cofferdam 400 on the ledge of the footing. Coupling the first sealing member 472 to the second side 446 of the bottom plate 442 prior to introducing the enclosure 440 into the body of water may provide a benefit of not having to place, couple, and/or bond an equivalent to the first sealing member 472 onto the ledge of the footing prior to and during seating of the cofferdam 400 on the ledge of the footing.

The cofferdam 400 may include a plurality of watertight tanks 474 coupled to the enclosure 440. In one aspect, the plurality of watertight tanks 474 may be coupled to the enclosure 440 by brackets welded to an outside of the wall 448 of the enclosure 440. The plurality of watertight tanks 474 will be discussed in greater detail in connection with FIGS. 5A, 5B, 6A, and 6B.

Figure 5A:
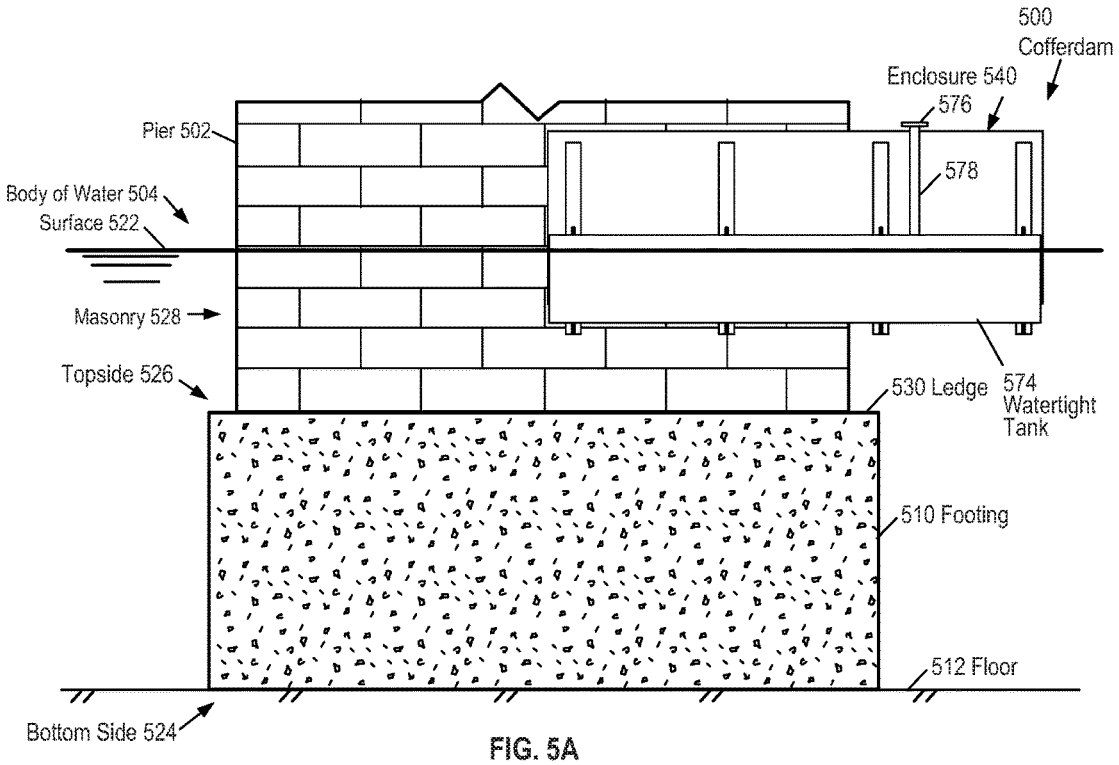
FIG. 5A is a side elevation view of a cofferdam floating in a body of water at a position above a footing, with a portion of a pier in an enclosure of the cofferdam in accordance with the disclosure.
Figure 5B:
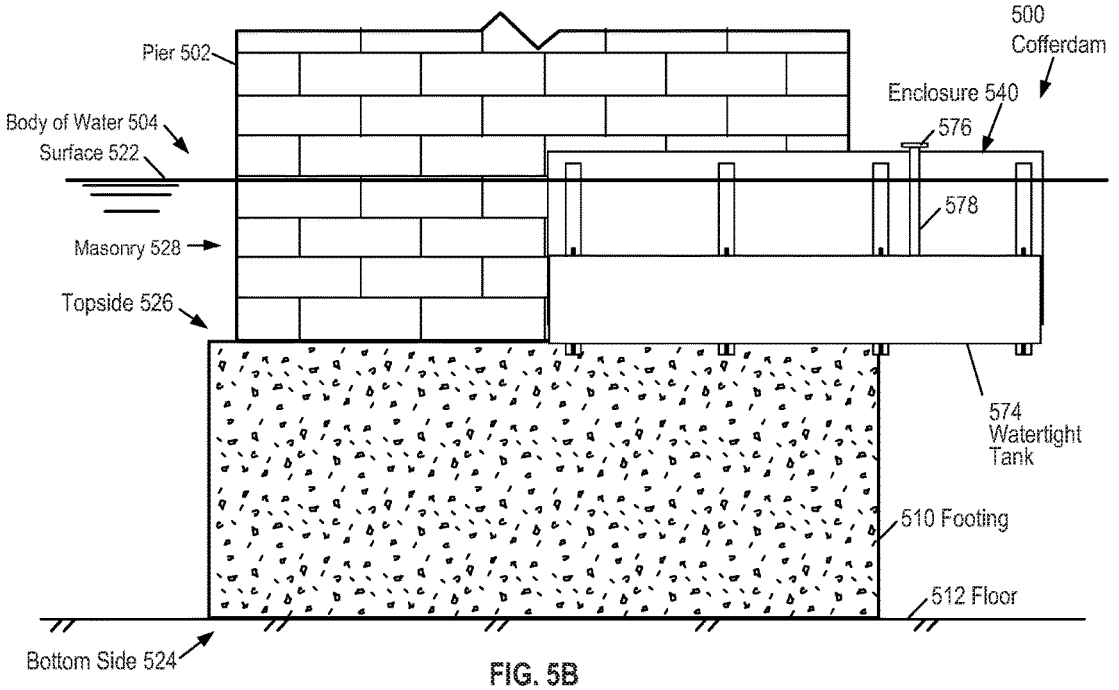
FIG. 5B is a side elevation view of the cofferdam of FIG. 5A seated on a ledge of the footing, with the portion of the pier in the enclosure of the cofferdam in accordance with the disclosure.
Figure 6A:
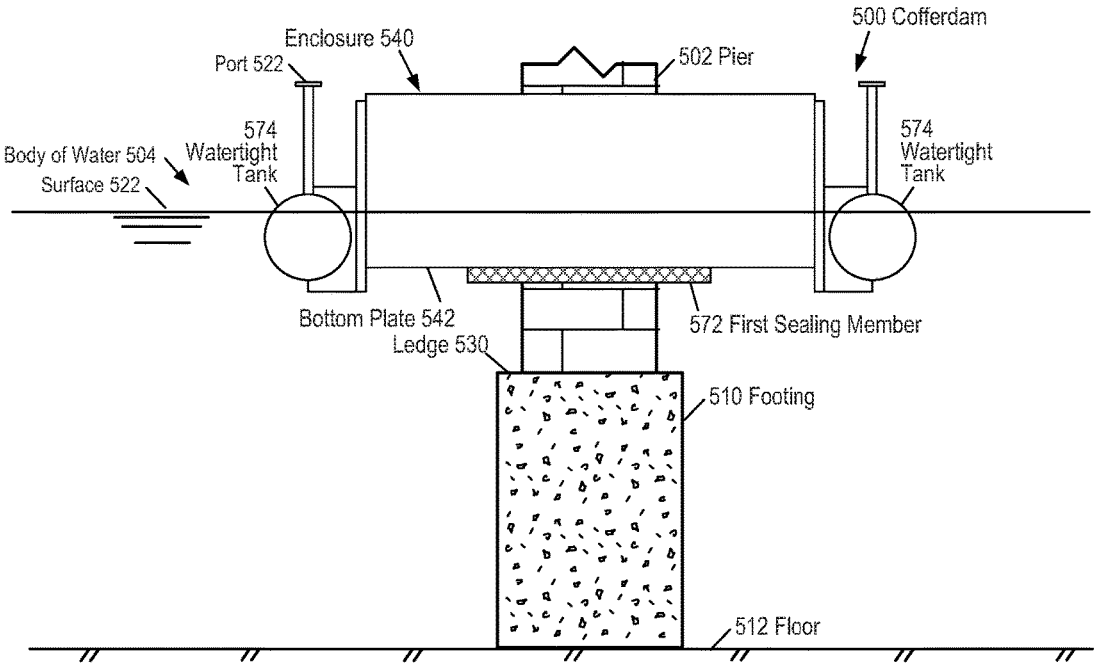
FIG. 6A is a front elevation view of the cofferdam of FIG. 5A floating in the body of water at the position above the footing, with the portion of the pier in the enclosure of the cofferdam in accordance with the disclosure.
Figure 6B:
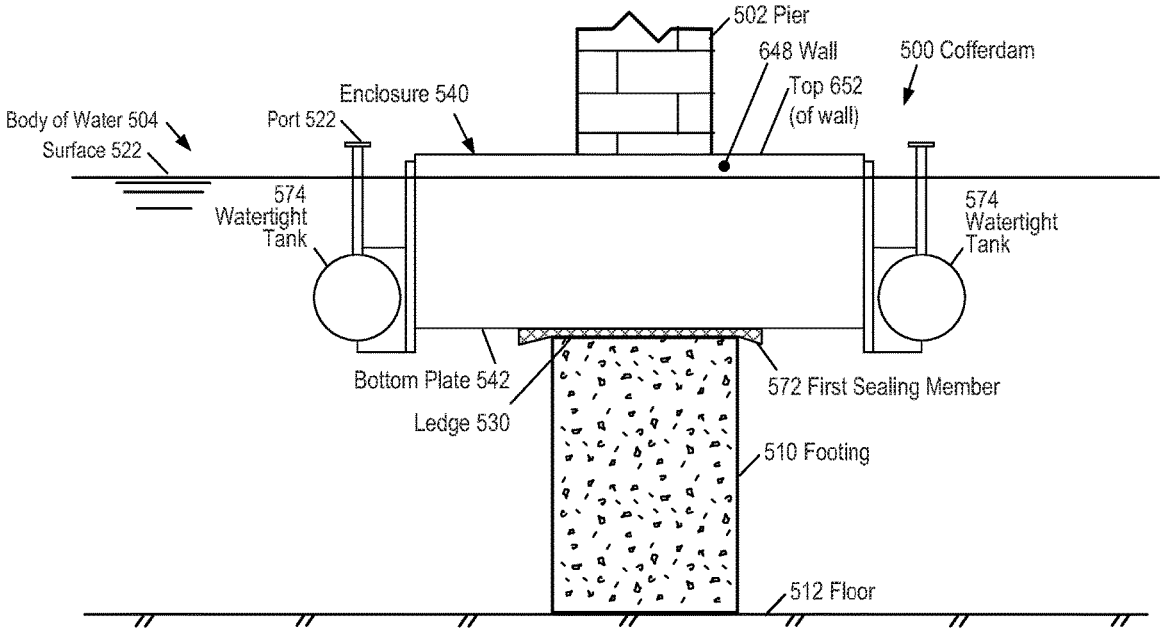
FIG. 6B is a front elevation view of the cofferdam of FIG. 5A seated on the ledge of the footing, with the portion of the pier in the enclosure of the cofferdam in accordance with the disclosure.

FIG. 5A and FIG. 6A illustrate a cofferdam 500 floating in a body of water 504 at a position above a footing 510 with a portion of a pier 502 in an enclosure 540 of the cofferdam 500, when a plurality of watertight tanks 574 is in an empty state in accordance with the disclosure. FIG. 5B and FIG. 6B illustrate the cofferdam 500 of FIG. 5A and FIG. 6A seated on the ledge 530 of the footing 510 with the portion of the pier 502 in the enclosure 540 of the cofferdam 500, when the plurality of watertight tanks 574 is in a filled state in accordance with the disclosure. The illustrations presented in FIGS. 5A and 5B are side elevation views (with respect to the pier 502 and footing 510). The illustrations presented in FIGS. 6A and 6B are front elevation views (with respect to the pier 502 and footing 510).

The plurality of watertight tanks 574 may provide buoyancy to the cofferdam 500. The buoyancy may be adjusted based on a shape of the watertight tanks 574 and a volume of water displaced by the watertight tanks 574. According to one example, each of the plurality of watertight tanks 574 may be fabricated of a 3.5 foot diameter 14 foot length of ¼ inch thick pipe having the ends closed (e.g., welded shut) by a corresponding thickness of steel plate. It will be appreciated by those of skill in the art that the plurality of watertight tanks 574 may be provided in shapes other than the right circular cylinders illustrated in the examples of the disclosure. However, it should also be appreciated that it is desirable to fabricate the cofferdam 500 economically (e.g., at a low cost); therefore, simplicity of design is beneficial. Pipe of various diameters, lengths, and thicknesses is readily available. A watertight tank formed as a right circular cylinder from pipe that is readily available may be less expensive to fabricate than another shape of watertight tank made from the same or different materials. Additionally, for simplicity and economy, according to one aspect, each of the plurality of watertight tanks 574 have no valves, ports, or openings below a surface 522 of the body of water 504, when the plurality of watertight tanks 574 are configured to float the cofferdam 500 in the body of water 504. The selection of the diameter, length, and thickness of the pipe or other structure used as a watertight tank are dependent on the circumstances of use and are within the skills of the person skilled in the art; they will not be described herein.

The plurality of watertight tanks 574 may be configured to float the cofferdam 500 in the body of water 504 when the plurality of watertight tanks 574 are in an empty state (e.g., empty, filled with air, not filled with water or other ballast). The plurality of watertight tanks 574 may be considered to be in an empty state or empty even when residual amounts of ballast, such as water, are contained within the plurality of watertight tanks 574. For example, when a pump is used to empty the watertight tanks 574 in accordance with the disclosure, a hose or pipe may be inserted into each of the watertight tanks 574 and water therein may be pumped out; however, a residual amount of water, which cannot be pumped from the watertight tanks 574, may remain. Nevertheless, the watertight tanks 574 may still be considered empty, or in an empty state, with the residual amount of water therein.

As shown in FIG. 5A and FIG. 6A, the plurality of watertight tanks 574 may be configured to float the enclosure 540 of the cofferdam 500 in the body of water 504, at a position above the footing 510 with the portion of the pier 502 in the enclosure 540, when the plurality of watertight tanks 574 is in an empty state.

As shown in FIG. 5B and FIG. 6B, the plurality of watertight tanks 574 may be further configured to sink the enclosure 540 of the cofferdam 500 in the body of water 504 from the position above the footing 510, bring the first sealing member 572 into contact with a ledge 530 on the footing 510, and compress the first sealing member 572 between the bottom plate 542 and the ledge 530, when the plurality of watertight tanks 574 is in a filled state. The aspects of bringing the first sealing member 572 into contact with a ledge 530 on the footing 510 and compressing the first sealing member 572 between the bottom plate 542 and the ledge 530 is more easily observed in the illustration of FIG. 6B (see deformation of first sealing member 572).

The plurality of watertight tanks 574 may be in a filled state when filled with a ballast such as water. The plurality of watertight tanks 574 may be heavier in the filled state than in the empty state.

As described above, the ledge 530 may be adjacent to the pier 502 and spaced apart from a floor 512 of the body of water 504. According to aspects described herein, a top 652 (FIG. 6B) of the wall 648 (FIG. 6B) of the enclosure 540 extends above a surface 522 of the body of water 504 when the first sealing member 572 contacts the ledge 530. According to one example, a maximum water level at high tide may be determined to be 4 feet higher than the ledge 530 of the footing 510. Accordingly, the wall 648 having a height greater than 4 feet above the bottom plate 542 can extend above a surface 522 of the body of water 504 when the first sealing member 572 contacts the ledge 530, even at high tide. It will be appreciated that the height of the wall 548 may be a function of the tide and the depth of the ledge 530 of the footing 510 below the surface 522 at high tide. The height of the wall 548 may be selected to prevent water from flowing into the enclosure 540 at high tide.

The plurality of watertight tanks 574 may be further configured to re-float the enclosure 540 in the body of water 504 when the plurality of watertight tanks 574 is returned to the empty state (e.g., emptied of water).

According to one aspect, each tank in the plurality of watertight tanks 474, 574 may be filled with water to obtain the filled state, and emptied of water to obtain the empty state, through a port 476, 576 on a topside of a watertight tank 474, 574. According to another aspect, each tank in the plurality of watertight tanks 474, 574 may be filled with water to obtain the filled state, and emptied of water to obtain the empty state, only through the port 476, 576 on the topside of the watertight tank 474, 574. According to one aspect, the port 476, 576 may be located at an end of a pipe 478, 578 extending upward from the topside of the watertight tank 474, 574, the end being distal to the topside of the watertight tank 474, 574, where a length of the pipe 478, 578 may be selected to maintain the port 476, 576 above the surface 522 of the body of water 504 when the first sealing member 472, 572 is in contact with the ledge 530 of the footing 510. In some aspects, the length of the pipe 478, 578 is selected to maintain the port above the surface of the body of water 504 in all expected tide and/or wave conditions when the first sealing member 472, 572 is in contact with the ledge 530 of the footing 510. A cover (not shown) may be provided to the port to seal the port from the atmosphere and/or from water.

Figure 7A:
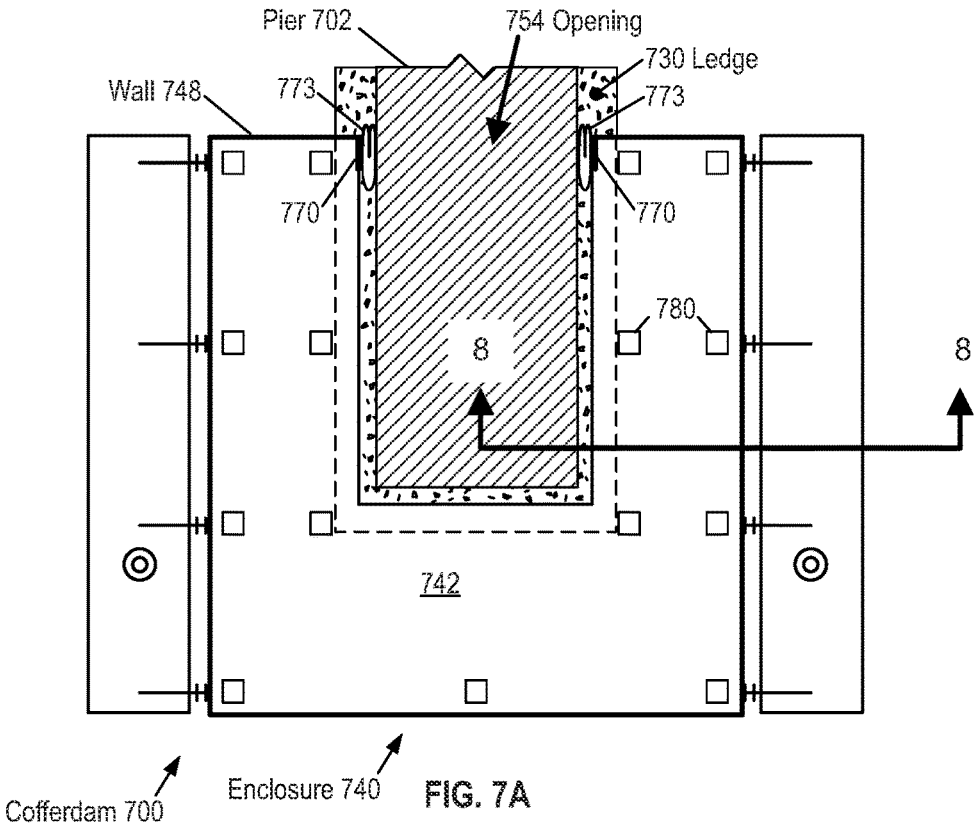
FIG. 7A is a plan view of a cofferdam for use with a pier extending above a surface of a body of water, from a footing below the surface of the body of water in accordance with the disclosure.

FIG. 7A is a plan view of a cofferdam 700 for use with a pier 702 extending above a surface of a body of water, from a footing 710 below the surface of the body of water in accordance with the disclosure. The illustration of FIG. 7A depicts the pier 702 within an opening 754 of an enclosure 740 of the cofferdam 700. A ledge 730 is shown in both plain and phantom line, to illustrate a positional relationship between the pier 702, the opening 754, and the ledge 730 with respect to the bottom plate 742. The portion of the opening 754 in the plane of the bottom plate 742 may have a profile corresponding to that of a pier of FIG. 2. FIG. 7A also depicts a distribution of a plurality of adjustable length structures 780 in an interior of the enclosure 740. Only two of the exemplary fifteen of plurality of adjustable length structures 780 are associated with a reference number to avoid cluttering the drawing. FIG. 7A also depicts a second sealing member 773 in a gap in the opening 754 between the pier 702 and a contact member 770 of a wall 748 of the enclosure 740.

Figure 7B:
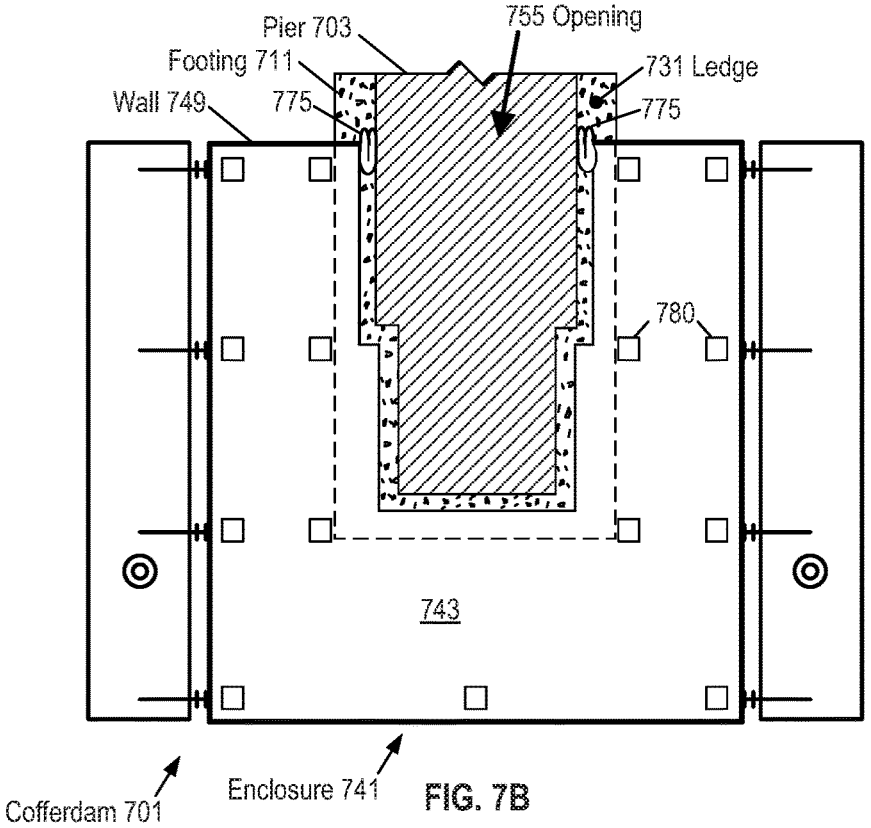
FIG. 7B is a plan view of another cofferdam for use with a pier extending above a surface of a body of water, from a footing below the surface of the body of water in accordance with the disclosure.

FIG. 7B is a plan view of another cofferdam 701 for use with a pier 703 extending above a surface of a body of water, from a footing 711 below the surface of the body of water in accordance with the disclosure. The illustration of FIG. 7B depicts the pier 703 within an opening 755 of an enclosure 741 of the cofferdam 701. A ledge 731 is shown in both plain and phantom line, to illustrate a positional relationship between the pier 703, the opening 755, and the ledge 731 with respect to the bottom plate 743. The portion of the opening 755 in the plane of the bottom plate 743 may have a profile corresponding to that of a pier of FIG. 3. FIG. 7B also depicts a distribution of a plurality of adjustable length structures 781 in an interior of the enclosure 741. Only two of the exemplary fifteen of plurality of adjustable length structures 781 are associated with a reference number to avoid cluttering the drawing. FIG. 7B also depicts a second sealing member 775 in a gap in the opening 755, between the pier 703 and wall 749 of the enclosure 741.

The examples of FIGS. 7A and 7B may be provided to illustrate that a cofferdam provided in accordance with this disclosure may be fabricated for use on a particularly shaped pier erected on a footing, and therefore the opening provided in the enclosure of the cofferdam may have a predetermined shape that may be fixed (e.g., not subject to change or fluctuation, not adjustable in shape). The cofferdam 400 fabricated in accordance with the present disclosure may be fabricated for economy and simplicity. This may be due to its temporary nature. Although the cofferdam fabricated in accordance with the present disclosure may be portable and reusable, the working lifetime of the cofferdam may be limited. Accordingly, in some aspects, the fixed nature of the opening 454 beneficially contributes to the economy and simplicity of the cofferdam 400. Adding features that would allow for the opening to conform its shape to piers of various shapes would increase the cost and complexity of the cofferdam and may detract from the economy and simplicity offered by the cofferdam fabricated with a fixed opening in accordance with some aspects of the disclosure.

Figure 8:
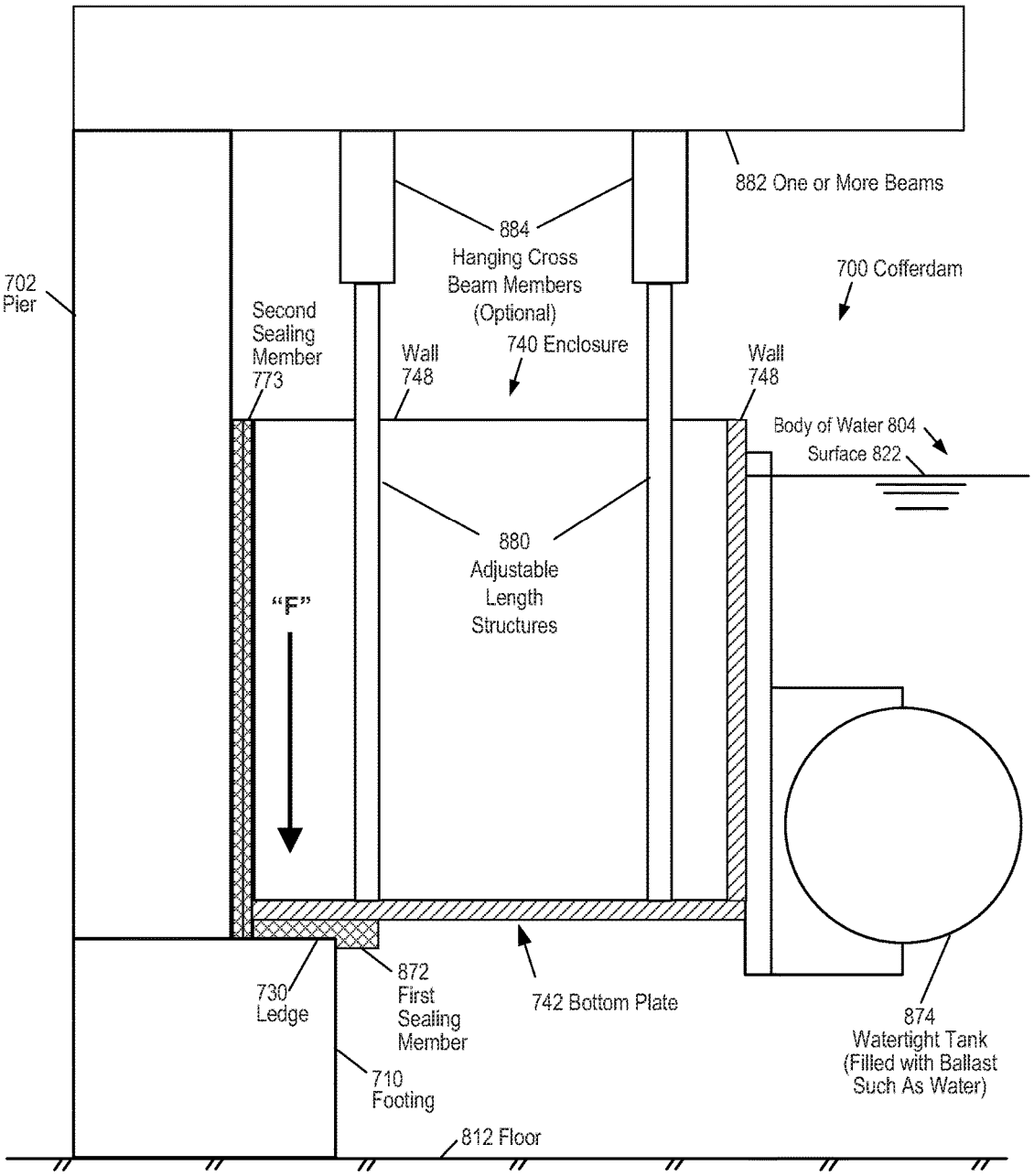
FIG. 8 is a cross sectional front side elevation view taken along the line 8-8 of FIG. 7A.

FIG. 8 is a cross sectional front side elevation view taken along the line 8-8 of FIG. 7A. The cofferdam 700 may include a plurality of adjustable length structures 880 provided on the first side 844 of the bottom plate 742. The adjustable length structures 880 may be coupled between the bottom plate 742 and one or more beams 882 of a bridge supported by the pier 702. The adjustable length structures 880 may be configured to exert a downward force ("F") on the bottom plate 742 when lengthened. The downward force, F, may act to secure the cofferdam 700 to the ledge 730 and oppose vertical and lateral forces imposed on the cofferdam 700. The vertical and lateral forces may be imposed on the cofferdam 700 by, for example, the actions of rising and falling tides, the flow of current, wave action, and debris hitting the side of the cofferdam 700.

Use of the adjustable length structures 880 may permit the cofferdam 700 to be secured to the ledge 730 of the footing 710 in a way that is temporary and/or non-destructive to the footing 710, the pier 702, and the one or more beams 882 of the bridge supported by the pier 702. Penetrating connectors do not need to be installed in the footing 710, the pier 702, or the beams 882 of the bridge to secure the cofferdam 700 to the ledge 730 of the footing 710. The cofferdam 700 may be secured from movement relative to the ledge 730 by the weight of the cofferdam 700 and the force, F, acting on the cofferdam 700 by lengthening of the adjustable length structures 880.

In some aspects, the plurality of adjustable length structures 880 may include adjustable length pipes, jack screws, and/or hydraulic rams. In some aspects, an adjustable length structure 880 may be formed of a fixed section of pipe (or other member having a different cross section), which supports, or is supported by, an adjustable length pipe, a jack screw, and/or a hydraulic ram. In one example, the fixed section of pipe may be a 3 to 4 inch diameter pipe of a given length. The selection of the constituent parts and load bearing capacity of the plurality of adjustable length structures 880 is dependent on the circumstances of use and are within the skills of the person skilled in the art; they will not be described herein.

In some aspects, the plurality of adjustable length structures 880 (or a subset of the plurality of adjustable length structures 880) may be coupled to a structure supported by a pier, such as to the one or more beams 882 of a bridge supported by the pier, directly and/or indirectly. Any of the adjustable length structures 880 could directly couple to a beam 882 of the bridge by, for example, directly contacting the beam 882. Any of the adjustable length structures 860 could indirectly couple to the one or more beams 882 of the bridge by, for example, placement of an intermediate structure between the one or more beams 882 and the adjustable length structure. Such intermediate structures may include hanging cross beam members 884. Use of intermediate structures such as hanging cross beam members 884 may be optional. In some aspects, the plurality of adjustable length structures 880 may be temporarily and/or non-destructively coupled to the structure supported by the pier.

Accordingly, in some aspects, the cofferdam 700 may further include a plurality of hanging cross beam members 884 coupled to the one or more beams 882 of the bridge to facilitate indirectly coupling the plurality of adjustable length structures 880 to the one or more beams 882. In some aspects, the plurality of hanging cross beam members 884 may be temporarily and/or non-destructively coupled to the one or more beams 882 of the bridge.

One or more of the plurality of hanging cross beam members 884 may be configured to be cantilevered and to extend beyond an edge of the bridge to provide a surface against which one or more of the plurality of adjustable length structures 880 may be lengthened to exert the downward force, F.

The hanging cross beam members 884 may be coupled to a plurality of beams of the bridge in a temporary and/or non-destructive manner. In one aspect the coupling may be achieved via a mechanism such as clamping. In one example, the clamps may be heavy duty clamps such as Bessey STB-12 clamps having a connection capacity of 4.88 kips (i.e., 4.88 thousand pounds-force). In one example, four clamps may be used to couple the hanging cross beam members to each of the beams of the bridge; two clamps on each side of a bottom flange of each of the beams of the bridge. The selection of the type of coupling and the connection capacity are dependent on the circumstances of use and are within the skills of the person skilled in the art; they will not be described herein.

The cofferdam 700 may further include a second sealing member 773 in a gap in the opening 754 (FIG. 7), between the pier 702 and wall 748 of the enclosure 740. Once the second sealing member 773 is in the gap in the opening 754, the first sealing member 872 and the second sealing member 773 may prevent the body of water from leaking around edges of the opening 754.

The selection of the thickness and type of material used for the second sealing member 773 and first sealing member 872 may be dependent on the circumstances of use and are within the skills of the person skilled in the art; they will not be described herein. However, in some aspects, the second sealing member 773 may be made from the same material as the first sealing member 872.

The length of the second sealing member 773 may correspond to the height of the opening 754 in the wall 748. In one aspect, the second sealing member 773 may be folded along its length to form, for example, a V-shape. Various tools may be used to force the second sealing member 773 into the gap. For example, a hammer may be used to manually force the second sealing member 773 into the gap.

Although reference is made to the second sealing member 773 in the singular, it will be understood that multiple lengths of the second sealing member 773 may be used in the opening 754, including multiple lengths on one or both sides of the opening 754 in spaces between the wall 748 and a pier 702 within the opening in the plane of the wall 748, and use of one length, or strip, on each side of the opening 754 in spaces (e.g., left and right spaces) between the wall 748 and a pier 702 within the opening in the plane of the wall 748 may be contemplated by recitation of the second sealing member 773 in the singular.

In some aspects, once the second sealing member 773 is in the gap in the opening 754 and the first sealing member 872 and second sealing member 773 provide a watertight seal, or a substantially watertight seal, around an edge of the opening 754, the enclosure 740 may be dewatered. At this point, either the weight of the water in the water-filled watertight tanks 874 and/or the force (F), if any, exerted in the downward direction by the adjustable length structures 880 should be sufficient to resist hydrostatic uplift due to the buoyancy created by dewatering the enclosure 740.

In aspects described herein, a cofferdam 700 does not contact, disturb, and/or penetrate the floor 812 of the body of water 804 below a surface 822 of the body of water 804 surrounding and/or in proximity to the footing 710 of a pier 702 for which the cofferdam 700 provides a dewatered worksite (e.g., dewatered enclosure 740).

Exemplary Method

Figure 9:
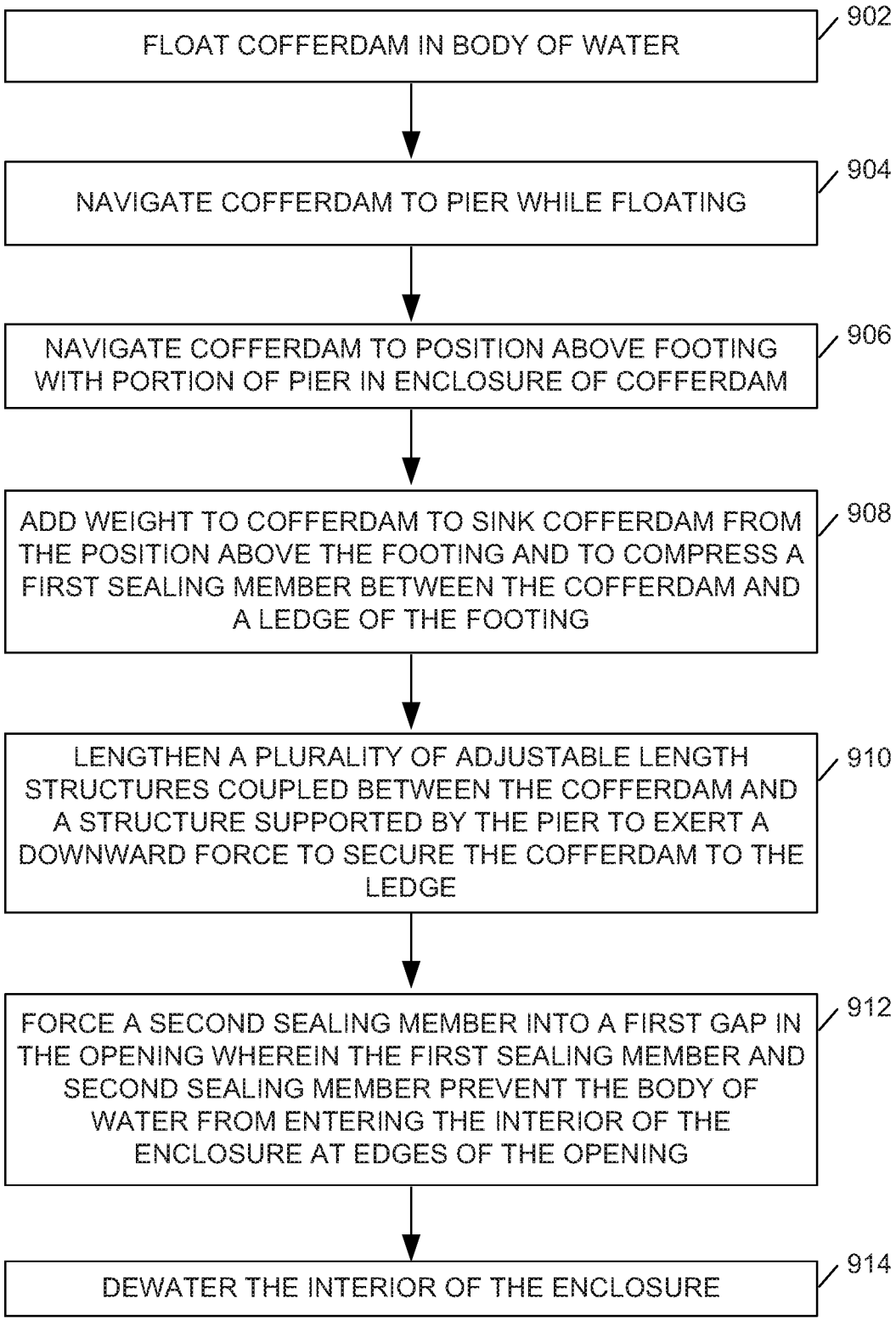
FIG. 9 is a flow diagram of a method of using a cofferdam with a pier extending above a surface of a body of water, from a footing below the surface of the body of water in accordance with the disclosure.

FIG. 9 is a flow diagram of a method of using a cofferdam with a pier extending above a surface of a body of water, from a footing below the surface of the body of water in accordance with the disclosure. The method may be used to dewater a space that is adjacent to the pier, without contacting a floor of a body of water surrounding the footing. The method may include floating the cofferdam in the body of water 902. As used herein, floating the cofferdam in the body of water may mean to float the cofferdam under its own buoyancy. The method may further include navigating the cofferdam to the pier while the cofferdam is floating 904. The method may also include navigating the cofferdam to a position above the footing with a portion of the pier in an enclosure of the cofferdam, while the cofferdam is floating 906. In aspects implementing the method, the enclosure may include a bottom plate having a perimeter, a first side bounded by the perimeter, and an opposing second side bounded by the perimeter. The enclosure may further include a wall having a base and an opposing top. The base may be coupled to the first side of the bottom plate at and/or adjacent to the perimeter. The wall along with the bottom plate may define an interior of the enclosure therein. The enclosure may also include an opening configured to pass the portion of the pier into the enclosure. The portion of the pier passed into the enclosure through the opening may pass through the wall and bottom plate of the enclosure. In some aspect, the opening may include a first portion (e.g., a first opening portion) in the wall that is aligned with a second portion (e.g., a second opening portion) in the bottom plate. The cofferdam may further include a first sealing member coupled to the second side of the bottom plate, adjacent to (e.g., at an outside border of) the second portion of the opening.

The method may further include adding weight to the cofferdam to sink the cofferdam from the position above the footing with the portion of the pier in the enclosure, to bring the first sealing member into contact with a ledge on the footing and compress the first sealing member between the bottom plate and the ledge 908. In aspects described herein, the ledge may be adjacent to the pier and spaced apart from the floor of the body of water, and the top of the wall may extend above a surface of the body of water when the first sealing member is in contact with the ledge.

The method may further include lengthening a plurality of adjustable length structures coupled between the cofferdam and/or the bottom plate of the cofferdam and one or more beams of a structure such as a bridge supported by the pier to exert a downward force on the bottom plate to secure the cofferdam to the ledge and oppose vertical and lateral forces imposed on the cofferdam 910.

The method may further include forcing (e.g., compelling, driving, pushing) a second sealing member into a first gap in the first portion of the opening between the pier and wall of the enclosure, wherein the first sealing member and the second sealing member prevent the body of water from entering the interior of the enclosure at edges of the opening 912.

The method may still further include dewatering the interior of the enclosure 914. In some aspects, the interior of the enclosure may be defined by a space is bounded by the wall of the cofferdam, the portion of the pier received in the opening, the bottom plate of the cofferdam, and any of the ledge exposed in a second gap in the opening between the pier and bottom plate of the cofferdam.

According to some aspects, the method may still further include coupling a motorized boat to the cofferdam to facilitate navigating the cofferdam.

According to aspects described herein, the cofferdam may include a plurality of watertight tanks configured to make the cofferdam buoyant in the body of water when the plurality of watertight tanks are empty, and adding weight to the cofferdam, may further include filling the plurality of watertight tanks with water.

According to some aspects, filing the plurality of watertight tanks with water may include pumping water into each tank in the plurality of watertight tanks only through a port on a topside of the tank. The port may be located at an end of a pipe extending upward from a topside of the tank, the end being distal to the topside of the tank. The length of the pipe may be selected to maintain the port above the surface of the body of water when the first sealing member is in contact with the ledge.

According to some aspects, forcing a second sealing member into the first gap may include positioning the second sealing member partially within the first gap and using manual labor to hammer the second sealing member into the first gap. In some aspects, the second sealing member may be a wedge-shaped resilient compressible product to facilitate forcing the second sealing member into the first gap.

According to some aspects, one or more of the plurality of adjustable length structures may be indirectly coupled to one or more beams of the bridge by a plurality of hanging cross beam members and a method disclosed herein may further include coupling, prior to lengthening, the plurality of hanging cross beam members to the beams of the bridge, and then lengthening the plurality of adjustable length structures to exert the downward force on the bottom plate to secure the cofferdam to the ledge and oppose vertical and lateral forces imposed on the cofferdam.

According to one aspect, the plurality of hanging cross beam members may be temporarily and/or non-destructively coupled to the one or more beams of the bridge.

According to one aspect, the plurality of hanging cross beam members may be configured to be cantilevered and to extend beyond an edge of the bridge to provide a surface against which the one or more of the plurality of adjustable length structures exert the downward force.

According to one aspect, the cofferdam includes a plurality of watertight tanks configured to make the cofferdam buoyant in the body of water when the plurality of watertight tanks are empty and float the cofferdam in the body of water, to remove the cofferdam from the pier. According to such an aspect, the method may further include filling the interior of the enclosure with water, forcing the second sealing member out of the first gap, and emptying water from the plurality of watertight tanks to refloat the cofferdam.

The term "exemplary" is used herein to mean "serving as an example, instance, or illustration." Any implementation or aspect described herein as "exemplary" is not necessarily to be construed as preferred or advantageous over other implementations or aspects.

The term "aspect" does not require that all aspects include the discussed aspect, or any discussed feature, advantage, and/or mode of operation.

The term "coupled" is used herein to refer to the direct or indirect coupling between two objects. For example, if object A physically touches object B, and object B touches object C, then objects A and C may still be considered coupled to one another—even if they do not directly physically touch each other.

One or more of the components, blocks, steps, features, and/or functions illustrated in above may be rearranged and/or combined into a single component, block, step, feature, or function or implemented in several components, blocks, steps, features, and/or functions. Additional components, blocks, steps, features, and/or functions may also be added without departing from novel features disclosed herein.

It is to be understood that the specific order or hierarchy of blocks in the methods disclosed is an illustration of exemplary processes. It is understood that the specific order or hierarchy of blocks in the methods may be rearranged. The accompanying method claims present elements of the various blocks in a sample order, and are not meant to be limited to the specific order or hierarchy presented unless specifically recited therein.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language of the claims, wherein reference to an element in the singular is not intended to mean "one and only one" unless specifically so stated, but rather "one or more." Unless specifically stated otherwise, the term "some" refers to one or more. A phrase referring to A and/or B a list of items refers to any combination of those items, including single members. As an example, "A and/or B" is intended to cover: A; B; A and B. All structural and functional equivalents to the elements of the various aspects described throughout this disclosure that are known or later come to be known to those of ordinary skill in the art are expressly incorporated herein by reference and are intended to be encompassed by the claims.

What is claimed is:

1. A method of using a cofferdam with a pier extending above a surface of a body of water, from a footing below the surface of the body of water, comprising:

floating the cofferdam in the body of water;

navigating the cofferdam to the pier while the cofferdam is floating;

navigating the cofferdam to a position above the footing with a portion of the pier in an enclosure of the cofferdam, while the cofferdam is floating, wherein the enclosure includes:

a bottom plate having a perimeter, a first side bounded by the perimeter, and an opposing second side bounded by the perimeter, a wall having a base and an opposing top, the base coupled to the first side of the bottom plate at and/or adjacent to the perimeter and, with the bottom plate, defining an interior of the enclosure therein, an opening configured to pass the portion of the pier into the enclosure, the opening comprised of a first portion in the wall that is aligned with a second portion in the bottom plate, and a first sealing member coupled to the second side of the bottom plate, adjacent to the second portion of the opening; and adding weight to the cofferdam to submerge the cofferdam from the position above the footing with the portion of the pier in the enclosure, to bring the first sealing member into contact with a ledge on the footing and compress the first sealing member between the bottom plate and the ledge, wherein the ledge is adjacent to the pier and spaced apart from a floor of the body of water and the top of the wall extends above a surface of the body of water;

lengthening a plurality of adjustable length structures coupled between the bottom plate and a structure supported by the pier to exert a downward force on the bottom plate to secure the cofferdam to the ledge and oppose vertical and lateral forces imposed on the cofferdam;

forcing a second sealing member into a first gap in the first portion of the opening between the pier and wall of the enclosure, wherein the first sealing member and the second sealing member prevent the body of water from entering the interior of the enclosure at edges of the opening; and dewatering the interior of the enclosure.

2. The method of claim 1, further comprising coupling a motorized boat to the cofferdam to facilitate navigating the cofferdam.

3. The method of claim 1, wherein the cofferdam includes a plurality of watertight tanks configured to make the cofferdam buoyant in the body of water when the plurality of watertight tanks are empty, and adding weight to the cofferdam, comprises:

filling the plurality of watertight tanks with water.

4. The method of claim 3, wherein filling comprises:

pumping water into each tank in the plurality of watertight tanks only through a port on a topside of the tank, wherein the port is located at an end of a pipe extending upward from the topside of the tank, the end being distal to the topside of the tank, to maintain the port above the surface of the body of water when the first sealing member is in contact with the ledge.

5. The method of claim 1, wherein forcing a second sealing member into the first gap comprises:

positioning the second sealing member partially within the first gap; and using manual labor to hammer the second sealing member into the first gap, wherein the second sealing member is a wedge-shaped resilient compressible product.

6. The method of claim 1, wherein the plurality of adjustable length structures are temporarily and non-destructively coupled to the structure supported by the pier.

7. The method of claim 1, wherein the structure supported by the pier is a bridge and one or more of the plurality of adjustable length structures are indirectly coupled to one or more beams of the bridge by a plurality of cross beam members, the method, further comprising:

coupling, prior to lengthening, the plurality of cross beam members to the beams of the bridge, and then lengthening the plurality of adjustable length structures to exert the downward force on the bottom plate to secure the cofferdam to the ledge and oppose vertical and lateral forces imposed on the cofferdam.

8. The method of claim 7, wherein the plurality of cross beam members are configured to be cantilevered and to extend beyond an edge of the bridge to provide a surface against which the one or more of the plurality of adjustable length structures exert the downward force.

9. The method of claim 1, wherein the cofferdam includes a plurality of watertight tanks configured to make the cofferdam buoyant in the body of water when the plurality of watertight tanks are empty and float the cofferdam in the body of water, to remove the cofferdam from the pier, the method further comprises:

filling the interior of the enclosure with water;

forcing the second sealing member out of the first gap; and emptying water from the plurality of watertight tanks to refloat the cofferdam.

* * * * *